US006783042B2

(12) United States Patent
Kaufer

(10) Patent No.: US 6,783,042 B2
(45) Date of Patent: Aug. 31, 2004

(54) POCKET TAPE DISPENSER

(76) Inventor: Edward Kaufer, P.O. Box 507, Reno, NV (US) 89504

( * ) Notice: Subject to any disclaimer, the term of this patent is extended or adjusted under 35 U.S.C. 154(b) by 147 days.

(21) Appl. No.: 09/800,451

(22) Filed: Mar. 7, 2001

(65) Prior Publication Data

US 2002/0170936 A1 Nov. 21, 2002

(51) Int. Cl.[7] ..... B65H 35/07; B26F 3/02

(52) U.S. Cl. ..... 225/1; 225/33; 225/43; 225/46; 225/89; 7/160; 30/1; 220/277

(58) Field of Search ..... 225/89, 1, 33, 225/43, 46, 55, 61, 59, 66; 7/158, 160, 170; 220/267, 277; 30/1

(56) References Cited

U.S. PATENT DOCUMENTS 1,212,068 A * 1/1917 Jones et al. ..... 225/89 X
2,576,091 A * 11/1951 McElroy ..... 225/89 X
2,701,692 A * 2/1955 Guyer ..... 225/33
3,102,671 A * 9/1963 Gershen ..... 225/43
3,109,570 A * 11/1963 Maddalena ..... 225/66
3,260,431 A * 7/1966 Ference ..... 225/89 X
3,762,261 A * 10/1973 Ekenberg ..... 225/89 X
5,933,893 A * 8/1999 Padden ..... 7/158
6,152,398 A * 11/2000 Chen ..... 225/66 X
6,331,087 B1 * 12/2001 Wang ..... 7/158 X
6,347,875 B1 * 2/2002 Painsith ..... 7/160 X
6,364,188 B1 * 4/2002 Dunshee ..... 225/1

* cited by examiner

*Primary Examiner*—Charles Goodman
(74) *Attorney, Agent, or Firm*—Herbert C. Schulze

(57) ABSTRACT

This is a method and apparatus for transport and cutting of a quantity of Duct Tape in which the tape is mounted upon a polyhedron mandrel containing a cutting blade so configured as to be cooperative with, and useful in, cutting of segments of the tape directly from the mandrel.

1 Claim, 5 Drawing Sheets

POCKET TAPE DISPENSER

CROSS REFERENCE TO RELATED PATENT APPLICATIONS

There application is related to my following application:

Serial Number: Filed: Now:

Ser. No. 09/934,008 Aug. 20, 2001 ABANDONED.

Ser. No. 09/934,007 Aug. 20, 2001 ABANDONED.

Ser. No. 09/934,340 Aug. 20, 2001 ABANDONED.

Ser. No. 09/967,968 May 29, 2001 ABANDONED.

BACKGROUND OF THE INVENTION

I. Field of the Invention

This invention is in the general field of protective methods and apparatus;

The invention is even more particularly in the general field of useful methods and apparatus for individuals of all levels of physical abilities to assist in overcoming difficult circumstances such as personal endangering situations, property protection, transport convenience and the like.

The invention is most particularly directed a particular product known as "Duct Tape" and a method and apparatus for enhancing its use.

II. Description of the Prior Art

There have been many cutting devices and the like for cutting tape of various types. There is no need to recite these devices as all are well known.

Tape, and in particular Duct Tape is well known. Duct Tape has been used for many purposes other than its primary intended use in plumbing and the like. For example, outdoors enthusiasts, handy persons, and the like have used Duct Tape for many purposes such as to repair clothing, to reinforce tent seams, to bundle diverse items together for transport, and the like.

However, all such uses contemplate a supply of tape on a roll of some sort. In some cases, people have wound small amounts of Duct Tape from a large roll onto a pencil, or other small object, in order to create a quantity of tape in a more convenient carrying package.

I have searched in the literature, patent files, commercial sources, and the like. I have found no readily useable, durable, and inexpensive device or method for carrying duct tape in an easily packed configuration, with appropriate and easily accessible cutting arrangements. Thus, I have found nothing which I consider to be prior art as to my present invention as is described below.

SUMMARY OF THE INVENTION

There are numerous situations in which individuals, regardless of their physical prowess, find themselves unable to cope with immediate and temporary emergencies. Such situations include those occasions when a person or an animal may become so unruly as to pose a grave danger to other persons, animals, or property. Such situations have made headlines recently where aircraft have been involved. Without explanation, individuals have become momentarily deranged and have endangered entire planeloads of passengers and cargo. One person under a momentary attack may be capable of holding a large number of others at bay. This can, and does, occur where animals need to be restrained. Also, emergency situations occur where it may be required to restrain cargo against violent movement which might threaten persons or other cargo.

Under emergency circumstances of the nature mentioned, and others, people frequently attempt to restrain objects, persons, and animals with rope, chains, and bare hands. Such attempts are frequently cumbersome and awkward, or may require such great strength and cooridination as to be ineffective.

Also, there are innumerable situations where persons are faced with a requirement for temporary repair, first aid, and the like. Such occurrences, and their solutions using Duct Tape or the like are particularly well known to outdoors persons. Duct Tape has been used for emergency splints, for tent and clothing repair, for shoes, and many other purposes.

In most of the situations mentioned above, and in many situations where binding, first aid, improvised repairs, and the like, are required, common Duct Tape can be used for temporary (and sometimes permanent) repair or improvisation. The use of Duct Tape is known to those skilled in various arts including, but not limited to, carpenters, plumbers, electricians, outdoors enthusiasts, and the like. Duct Tape is customarily available in large rolls. This particular characteristic of various ducts tapes and the like causes such tape to be less than fully effective for emergency uses due to the difficulty in carrying and applying such large rolls.

This invention is directed to making Duct Tape easily available and useable under a variety of circumstances. Although I have searched through literature, other publications, patents, and the like I have found no prior art as to a convenient way for the average person to carry and utilize Duct Tape for whatever circumstance may arise.

I have now conceived and developed an apparatus and method for packaging, carrying, and using duct tape convenient and economical for all persons and situations. I have done this by constructing a device which carries a variety of cutting and application Duct Tape tools together with a manageable and convenient quantity of Duct Tape.

It is an object of this invention to provide a means for convenient carrying of a useable quantity of Duct Tape;

It is another object of this invention to provide such means in cooperative relationship with a means to cut convenient lengths of the Duct Tape;

Another object of this invention is to provide such a method for proper utilization of such Duct Tape under adverse conditions;

The foregoing and other objects and advantages of this invention will become apparent to those skilled in the art upon reading the following description of preferred embodiments together with a review of the appended drawings.

DESCRIPTION OF A PREFERRED EMBODIMENT

Figure 1:
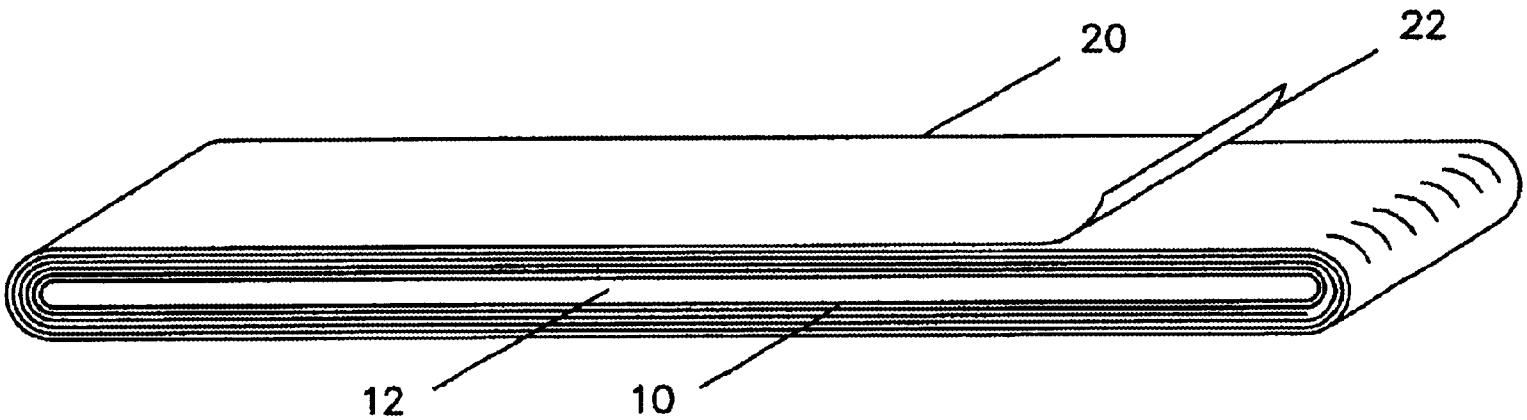
FIG. 1 is a schematic perspective of an apparatus suitable to practice the methods of this invention.

An inventory of the items bearing reference numerals on the drawings is:

| Numeral | Identification of item |
|---|---|
| 10 | hollow polyhedron tape mandrel |
| 12 | slot through hollow polyhedron tape mandrel |
| 13 | blade |
| 14 | sharpened edge of blade |
| 15 | blade backing handle |
| 16 | serrated blade |
| 17 | serrated blade edge |
| 18 | serrated blade backing handle |
| 19 | hook on blade backing |
| 19a | hook on blade backing |
| 20 | tape wound around mandrel |
| 22 | lifted end of tape |
| 110 | hollow polyhedron tape mandrel |
| 112 | slot through hollow polyhedron mandrel |
| 113 | enlarged pivot position |
| 114 | pivot holes in mandrel |
| 115 | pivot pin |
| 117 | swivel flexible blade mounting |
| 118 | swivel flexible blade |
| 119 | swivel flexible blade in transport mode |
| 120 | tape wound on mandrel |
| 121 | edge of tape |
| 122 | serrated cutting edge |
| 123 | intermediate position of blade |

Figure 2:
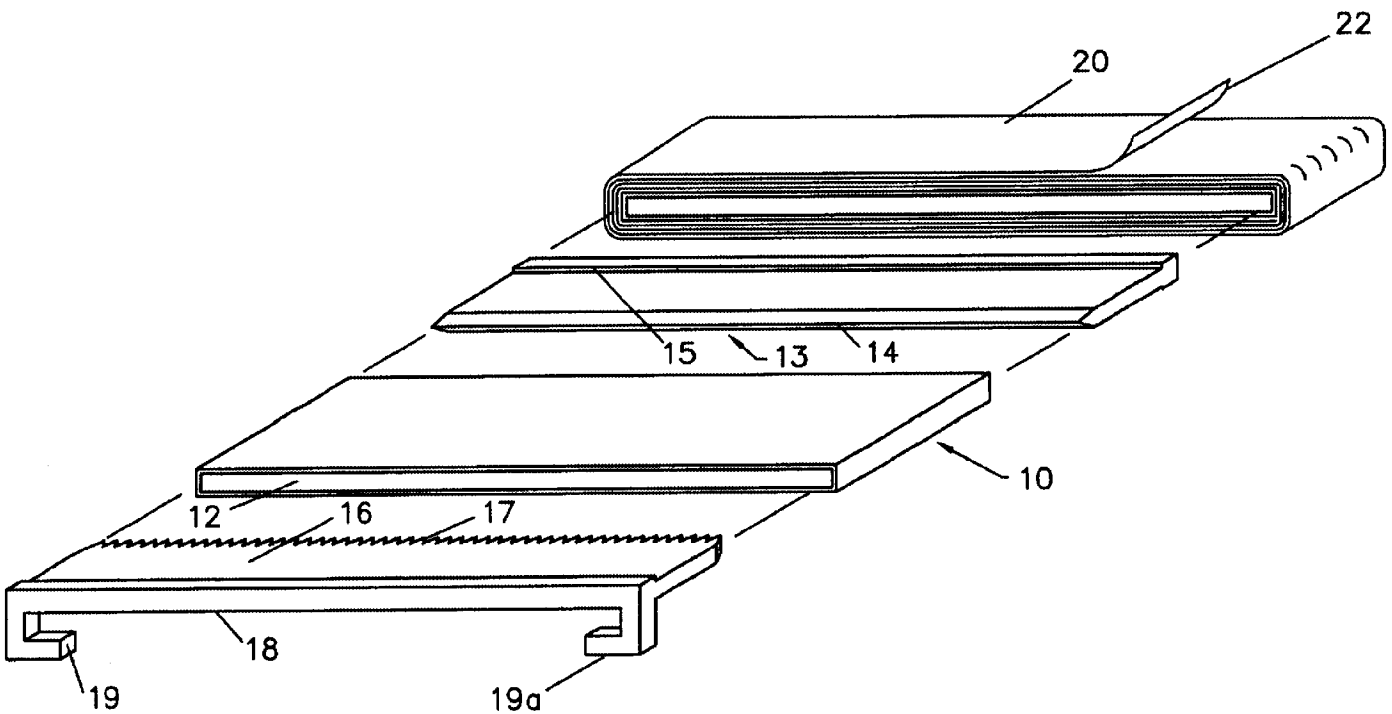
FIG. 2 is an exploded view of the apparatus of FIG. 1.

Referring to FIGS. 1 and 2 together, it will be noted that a hollow polyhedron mandrel 10 is the base for a length of duct tape 20 which is wound around the mandrel as shown.

The mandrel in this case has a rectangular cross section. Those skilled in the art will realize that other configurations of mandrel might be used, but the most convenient and useful for the purposes for which this invention is made is as shown.

The mandrel 10 is hollow and carries within its hollow inner portion, or slot, 12 two knife-like instruments 13 and 16. The blade instrument 13 has a sharp knife edge 14 and an elongated enlarged handle 15 adapted to fit snugly within the slot 12. The knife edge 14 can be used to cut the tape or for any other knife and cutting purposes. The blade instrument 16 has a serrated edge 17 and enlarged elongate handle 18 suitable to fit properly within the slot 12.

The blade instrument handle 18 may be fitted with two hook-like projections 19 and 19*a*. The hook-like projections will be moveably mounted in a manner which will be apparent to those skilled in the art so that they may be hooked firmly into opposite ends of the slot in order to clamp the serrated blade flat onto the tape 20 to provide easily adaptable and controllable cutting of desired lengths of the tape. It will be understood by those skilled in the art that a similar arrangement can be made to work with the cutting blade 13.

Figure 3:
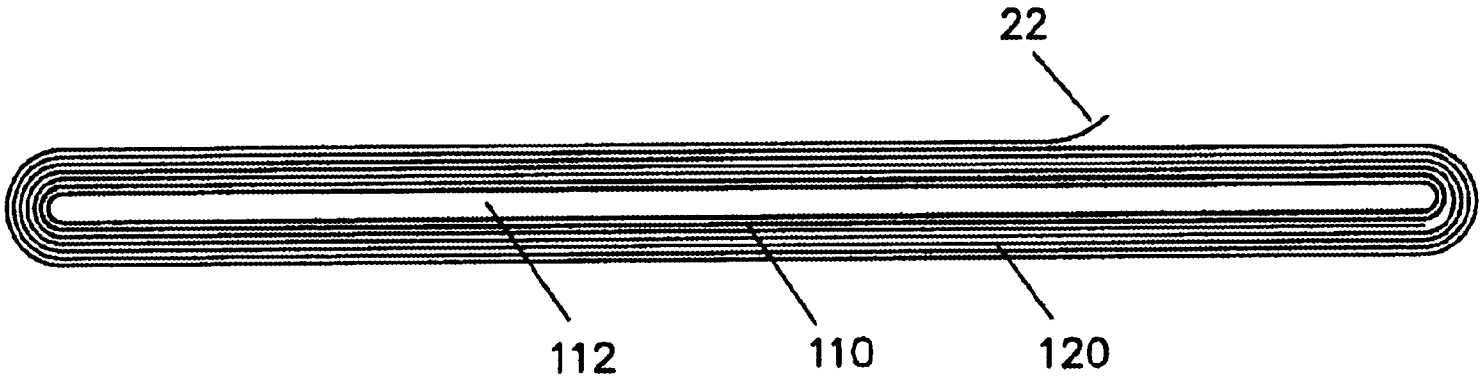
FIG. 3 is a side elevation of an alternate embodiment of an apparatus suitable to practice the method of this invention with a quantity of Duct Tape mounted thereon.

FIG. 3 is a side elevation of an alternate embodiment of this invention. A polyhedron mandrel 110 with hollow interior 112 is shown with Duct Tape 120 wound about the mandrel. The edge of the tape 121 will be lifted when desired to peel off a length of tape for a desired purpose.

Figure 4:
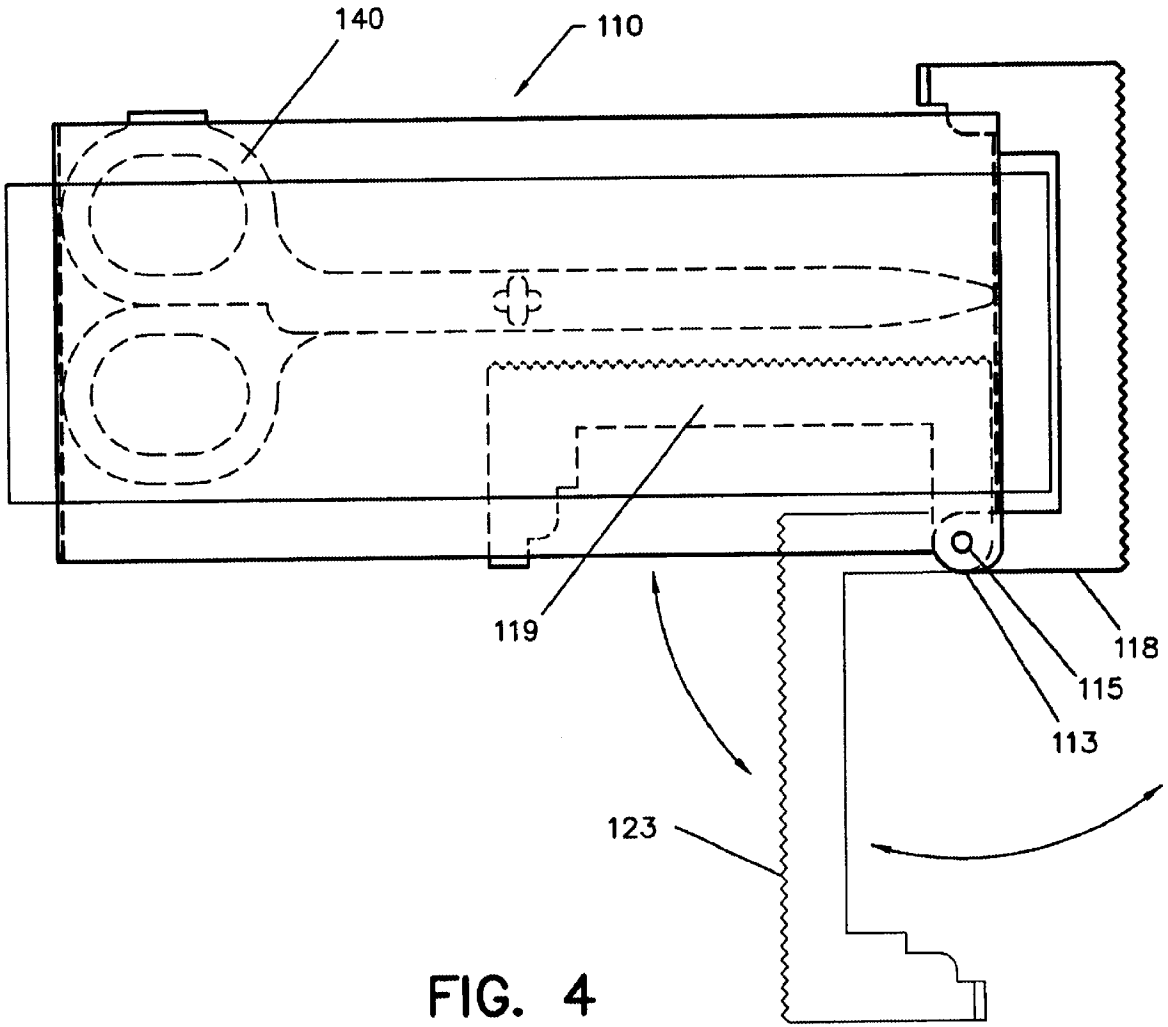
FIG. 4 is a schematic top elevation of the apparatus of FIG. 3, with elements in phantom.

FIG. 4 is a schematic top elevation of the apparatus of FIG. 3. Various elements are shown in phantom for a clear understanding of the interaction and relationship of the elements. A swivel blade, or cutting member, 118, with serrated edge 122 is shown in position for use in cutting a length of tape. The two phantom positions of the swivel blade show how it is in transport mode 119, and intermediate 123. The unique shape of the blade 118 is important. The shoulder 124 rests against the mandrel 110 as indicated. This allows for clean cutting of the tape as will be understood by those skilled in the art. The scissors, 140 is provided for use in trimming tape, or for other purposes at a location distant from the mandrel and blade 118.

Figure 5:
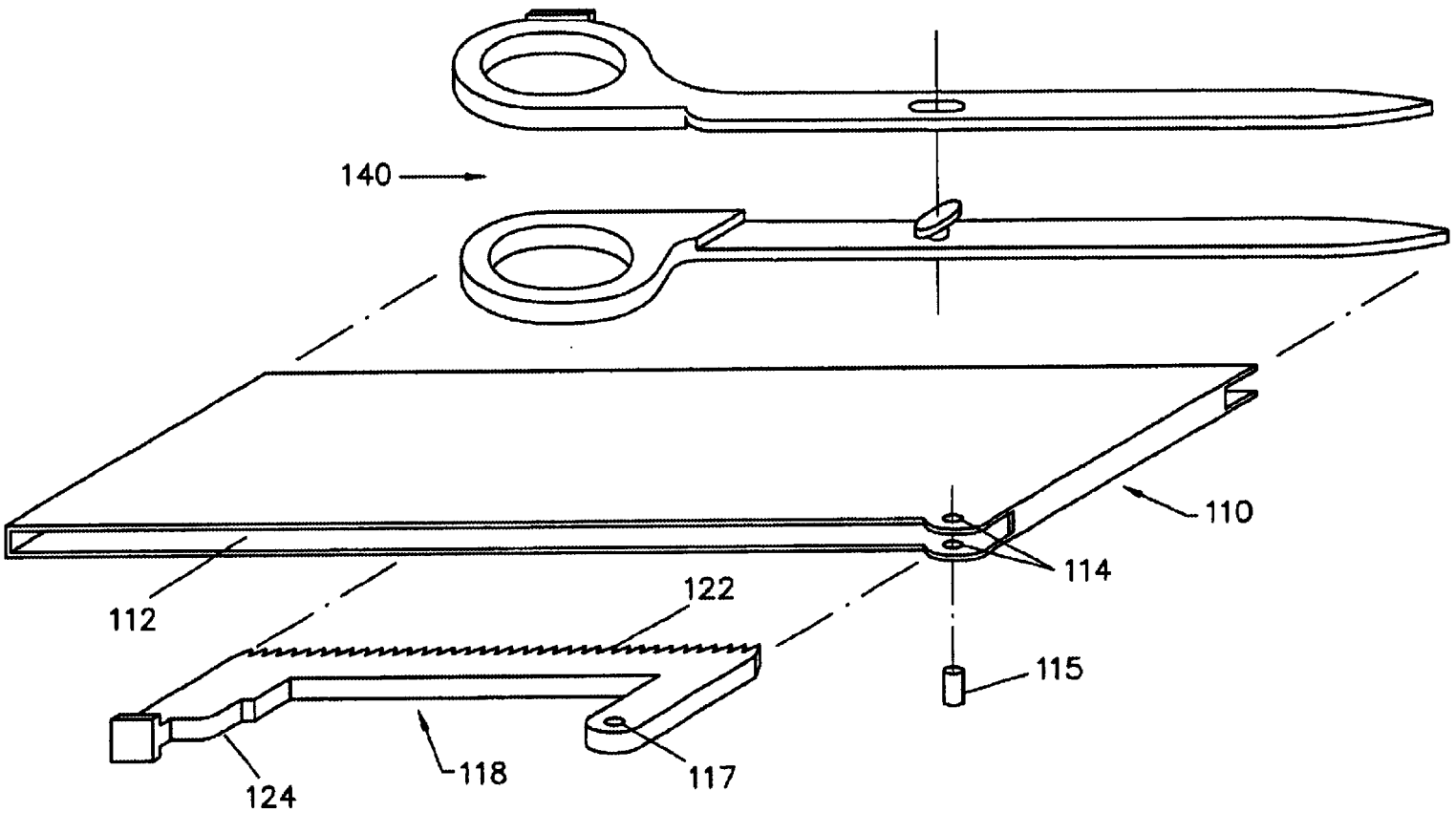
FIG. 5 is an exploded view of the apparatus of FIGS. 3 and 4.

FIG. 5 is an exploded view of the mandrel, blade, and scissors combination. This will be understood by those skilled in the art.

It is generally preferred that this item and all of the components be made of plastic material. This is preferred because of weight, resistance to corrosion, and the like as will be understood by those skilled in the art. However, it is to be understood that the invention is not limited in that regard, since other materials, such as metals, and the like, now in use, or to become discovered in the future, may be deemed desirable by some users.

In the claims which follow, if I should fail to claim a patentable feature of this invention, such failure to claim will be due to inadvertence and not due to any intent to abandon, or dedicate such feature. In the event I learn of any such patentable feature which I have not claimed, I shall immediately seek to claim such feature by re-issue or other appropriate action.

While the embodiments of this invention shown and described are fully capable of achieving the objects and advantages desired, it is to be understood that such embodiments have been shown for purposes of illustration and not for purposes of limitation.

I claim:

1. A method for utilization of Duct Tape comprising: winding an elongate length of Duct Tape upon a hollow polyhedron mandrel which mandrel contains a swivel mounted tape cutting tool; moving the swivel mounted tape cutting tool into a position such that a portion of the Duct Tape may be severed by pressure against the cutting tool; unwinding a portion of the elongate length of Duct Tape from the mandrel; severing the portion of Duct Tape by pressure against the cutting tool; and utilizing the severed portion of Duct Tape including trimming the severed portion by the use of trimming scissors carried by said mandrel.

* * * * *